US005685569A

United States Patent [19]

Chou

[11] Patent Number: 5,685,569

[45] Date of Patent: Nov. 11, 1997

[54] STRUCTURE OF BOOK PAGE

[76] Inventor: Lee Ho Chou, 7F-2, No. 95-8 Chang Ping Road, Sec. 1, Taichung, Taiwan

[21] Appl. No.: 570,090

[22] Filed: Dec. 11, 1995

[51] Int. Cl.[6] ..... B42D 1/00

[52] U.S. Cl. ..... 281/38; 281/211

[58] Field of Search ..... 281/38, 51, 15.1, 281/21.1, 22, 26, 27; 42/79

[56] References Cited

U.S. PATENT DOCUMENTS

| | | | |
|---|---|---|---|
| 4,577,889 | 3/1986 | Schulz | 281/38 X |
| 4,810,007 | 3/1989 | Nam | 281/38 X |
| 5,098,127 | 3/1992 | Williamson et al. | 281/38 X |

*Primary Examiner*—Willmon Fridie, Jr.

[57] ABSTRACT

A structure of book page for binding a book or album comprises a wide rectangular portion abutting a narrow rectangular portion, a pair of first flap members abutting two ends and a second flap portion abutting an outward side of the wide rectangular portion. Both the narrow rectangular portion and the pair of first flap members are folded upward along their predetermined folding lines and stuck up on the upper surface of the wide rectangular portion, whereas the second flap member is folded downward along a predetermined folding line and movably mats the under side of the wide rectangular portion. So that a double-layer book page is therefore accomplished with a concave strip on the upper surface and a movable convex strip on the under side along the inside margin of the book page. When binding, nest and stick up the movable convex strip of every upper page into the adjacent lower pages and bind with hard covers.

7 Claims, 7 Drawing Sheets

STRUCTURE OF BOOK PAGE

BACKGROUND OF THE INVENTION

The present invention relates to book binking, more particularly to an improved structure of book page which is advantageous to the book binding and keeps the book such as an album in uniform thickness without hemmed with selvages.

An autogragh book, album, slamp collection book and the like alway untilze thick paper or cardboard as their interior pages and bind with hard covers. To safeguard the book to be durable and elegant, the interior pages are hemmed with selvages and made a foldout strip at the inside margin (as shown in FIG. 1). The pages are bound at their foldout inside margins so as to make the inside margin of the book thicker than it's outside margin, therefore sacrificing the uniform thickness of the book.

In another instance, people employ double-layer interior pages. Each page is made of an elongate rectangular paper and folded over in the manner as to form a concave strip along the upper surface and a convex strip along the under side of it's inside margin. These book pages are gathered by nesting the convex strip of the upper pages to the concave strip of their respective lower pages. So that an uniform thickness of a book is obtained upon the binding of the book. However, other margins of the double pages are to be hemmed with selvages to protect their exposed edges from damagement of hair-side. This costs a great time and material to manufacture.

SUMMARY OF THE PRESENT INVENTION

The present invention has a main object to provide a structure of book page which is a novel arrangement of double-layer papers bound to be in uniform thickness without hemming with selvages so as to save time and material to manufacture.

Accordingly, the book page of the present invention comprises a phurality double-layer interior pages, each is made of an elongate paper or cardboard folded over into double-layer. The paper is previously cut four frustums which forms an interior angle of about 135 degrees with the edges of the paper therebetween. Two of the frustums are at the corners of the wide portion of the paper, and other two frustums are at the median portion of the paper so as to form a narrow portion abutting the wide portion thereof, a pair of first, a second and third folding lines are arranged along respective margins of the wide portion for upwardly folding the narrow portion and a pair of lateral flap members which are stuck on the upper surface of the wide portion and downward folding an outward flap member to mat with the under side thereof. this arrangement forms a double-layer interior book page which has a concave strip and a corresponding movable convex strip on the upper and under sides of the inside margin of the page respectively.

When binding, gather the interior book pages together by nesting and sticking the convex strip of every page into a corresponding concave strip of the adjacent lower pages at first, and then bind with hard covers. Because of the folded over margins of the pages, the edges thereof will be durable without creating hair-side and the book will be in uniform thickness.

The present invention will become more fully understood by reference to the following detailed description thereof when read in conjunction with the attached drawings.

DETAILED DESCRIPTION OF THE PREFERRED EMBODIMENT

Figure 1:
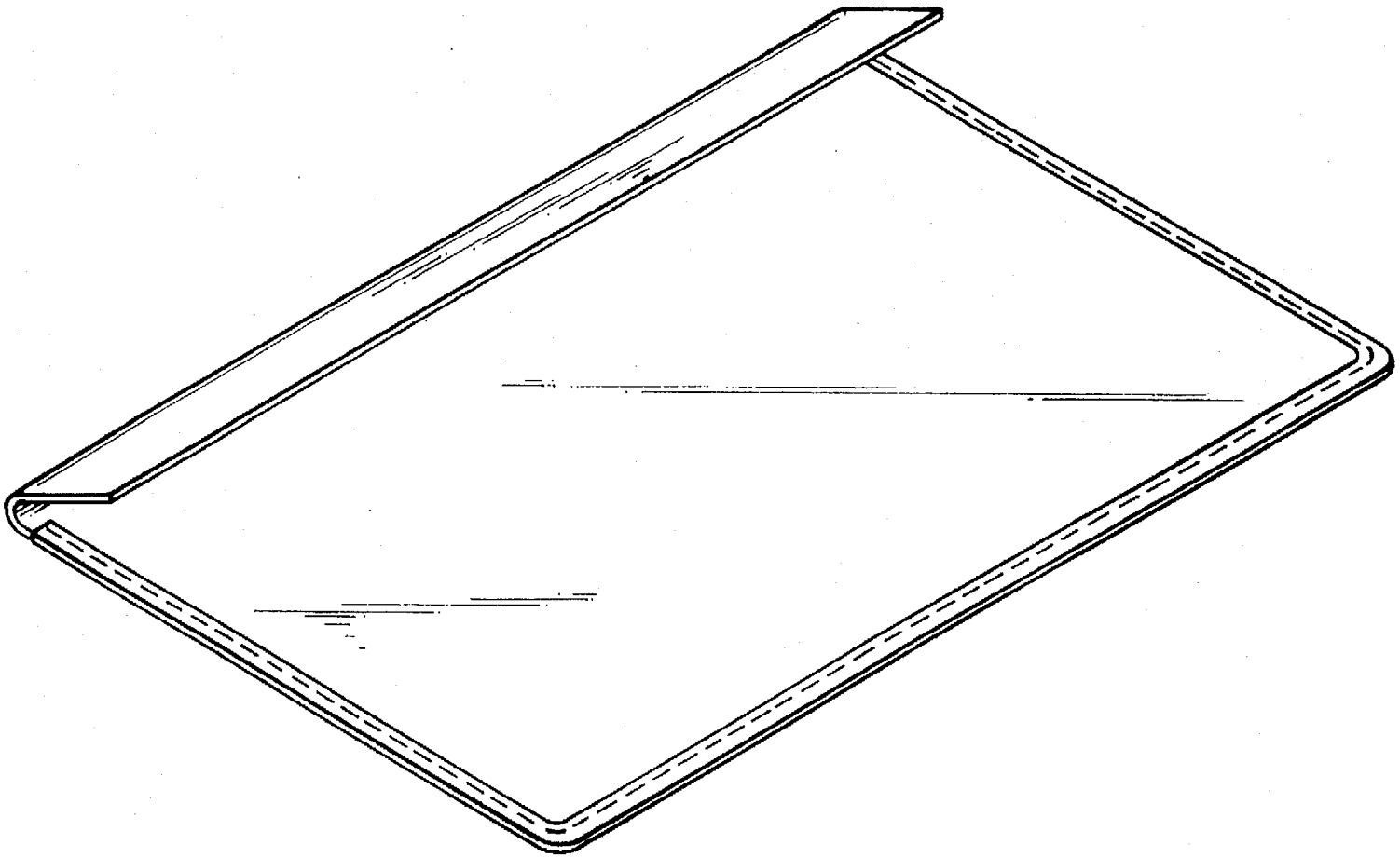
FIG. 1 PRIOR ART
FIG. 1 is a perspective view to show an interior book page of a prior art.
Figure 2:
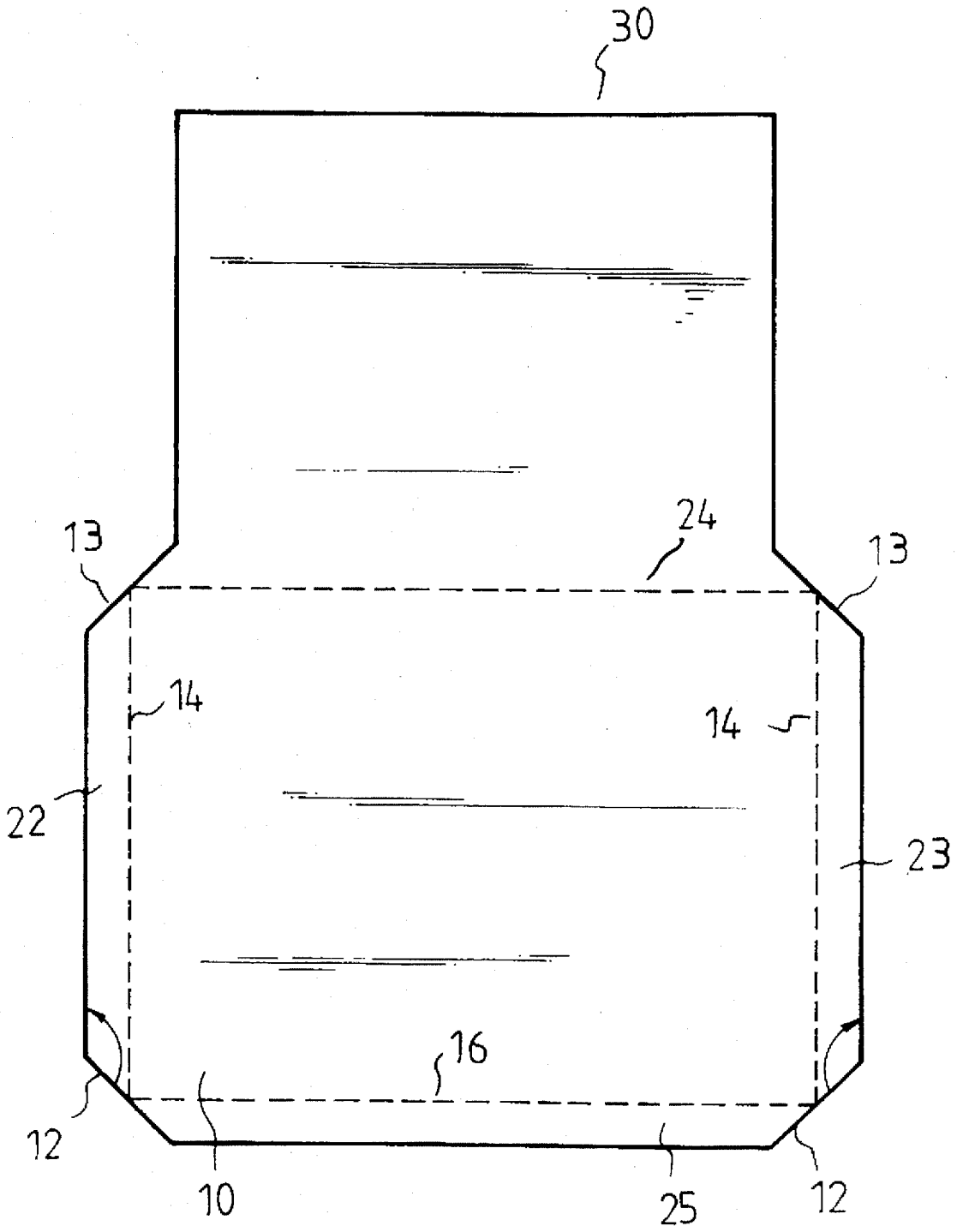
FIG. 2 is a top plane view of a preferred embodiment of the present invention.

With reference to FIG. 2 of a top plane view which illustrates a first embodiment in unfolded condition comprises an elongate rectangular paper or cardboard which has been cut four frustums 12 and 13, two of them are at the outward corners of a wide portion 10 and the other two of them at a median portion of the paper respectively, the frustums 12 and 13 form an interior angle of about 135 degrees with the adjacent edges of the wide portion therebetween. A narrow portion 30 which is slightly shorter than the wider portion 10 abuts the median frustums 13 and extends outward therefrom. A pair of first folding lines 14 connect the centers of an outward frustum 12 and a median frustum 13 and extend parallel along the length of the lateral edges of the wide portion. A second folding line 24 connects the centers of the two median frustums and extended along a suggestive dividing line between the wide portion 10 and the narrow portion 30. Finally, a third folding line 16 connects the centers of the two outward frustums 12 and extended parallel to line 24. So that three flap members 22, 23 and 25 are respectively defined at three side of the wide portion 10.

Figure 3:
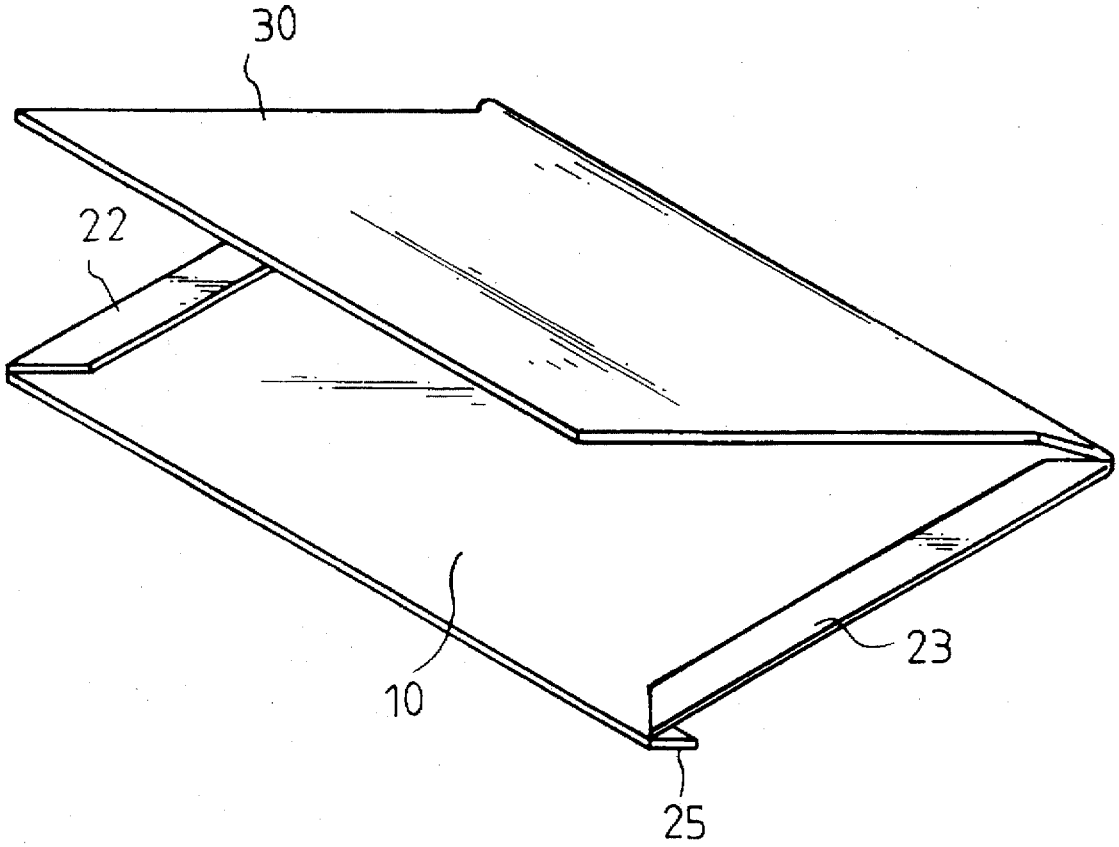
FIG. 3 is a perspective view to show a folded out book page of FIG.2.

Referring to FIG.3 to achieve a double-layer book page is to fold the narrow portion 30 and the two flap members 22 and 23 upward along their folding line 14 and 24 and stick up on the upper surface of the wide portion 10, where, the flap member 25 is to fold downward along line 16 and movably overlies on the under side of the wide portion 10, you will see that a concave strip appears on the upper surface mating with a corresponding movable convex strip on the under side of the inside margin of the double-layer book page. When binding, gather the book page together by nesting the movable convex strip of the upper pages into the concave strip of their adjacent lower pages and stuck therein and then bind in hard covers. Upon this arrangement, the bound book or album will be in uniform thickness and the exposed edges of the interior pages are inforced without causing hairside, therefore saving the time and material to hem the selvages thereon.

Figure 4:
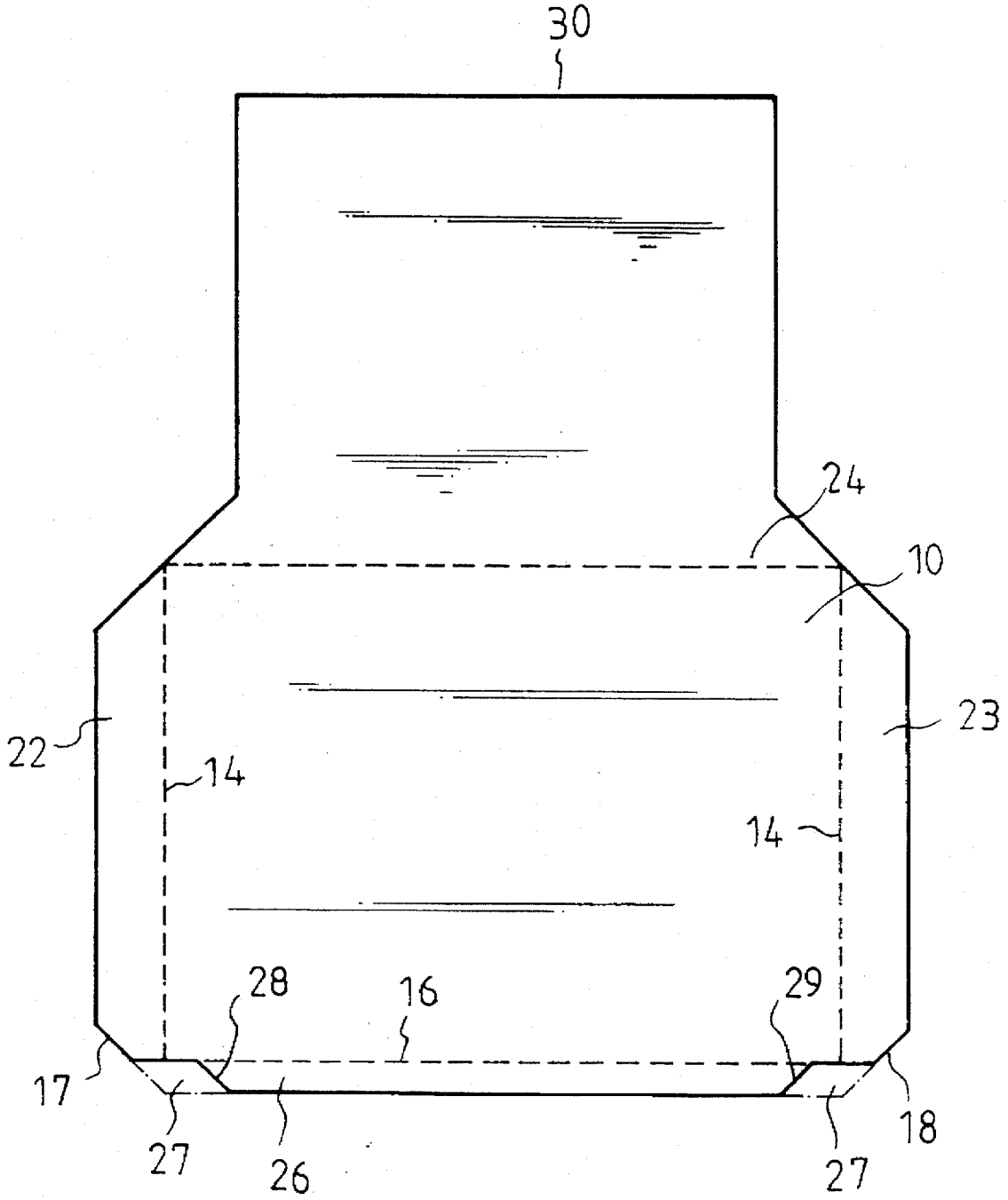
FIG. 4 is a top plane view to show an altenative embodiment of the present invention.

Referring to FIG. 4, an alternative embodiment of the present invention is shown. In this embodiment, the general structure and function are similar to the embodiment illustrated in FIGS. 2 to 3 and the above discussion is equally applicable to this embodiment in most instance, only the flap member 25 is shortened and a new reference number is given as 26. A small portion 27 between flap members 22 and 25, and 23 and 25 are cut out so as to define a hypotenuse 28 and 29 respectively. When the the nerrow portion 30 and the flap members 22, 23 and 26 are folded over in the manner as applied in the above embodiment, both the concave strip and the convex strip will be shorter than that of the above embodiment. This modification provides that the corners of the inside margin of the double-layer book page will be more durable.

Figure 5:
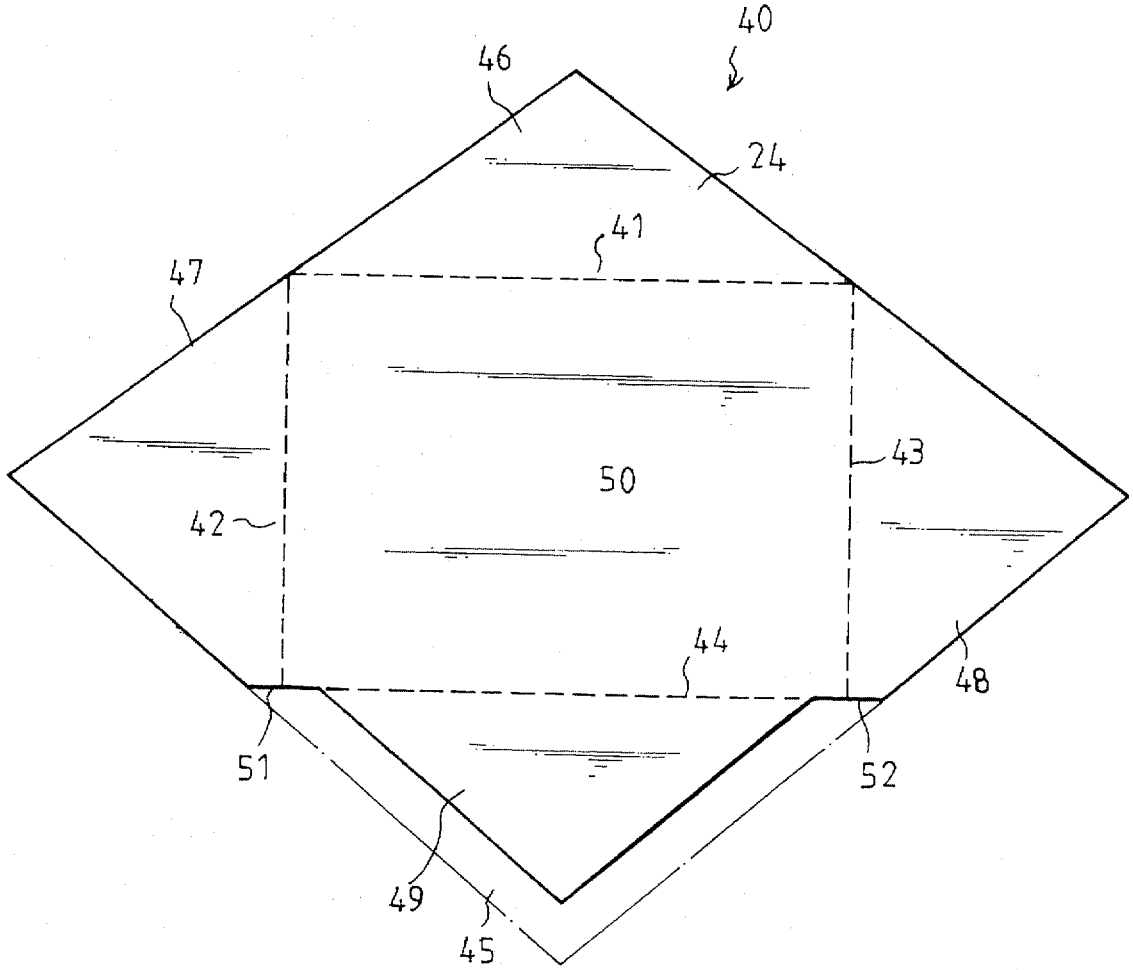
FIG. 5 is a top plane view to show another alternative embodiment of the present invention.
Figure 6:
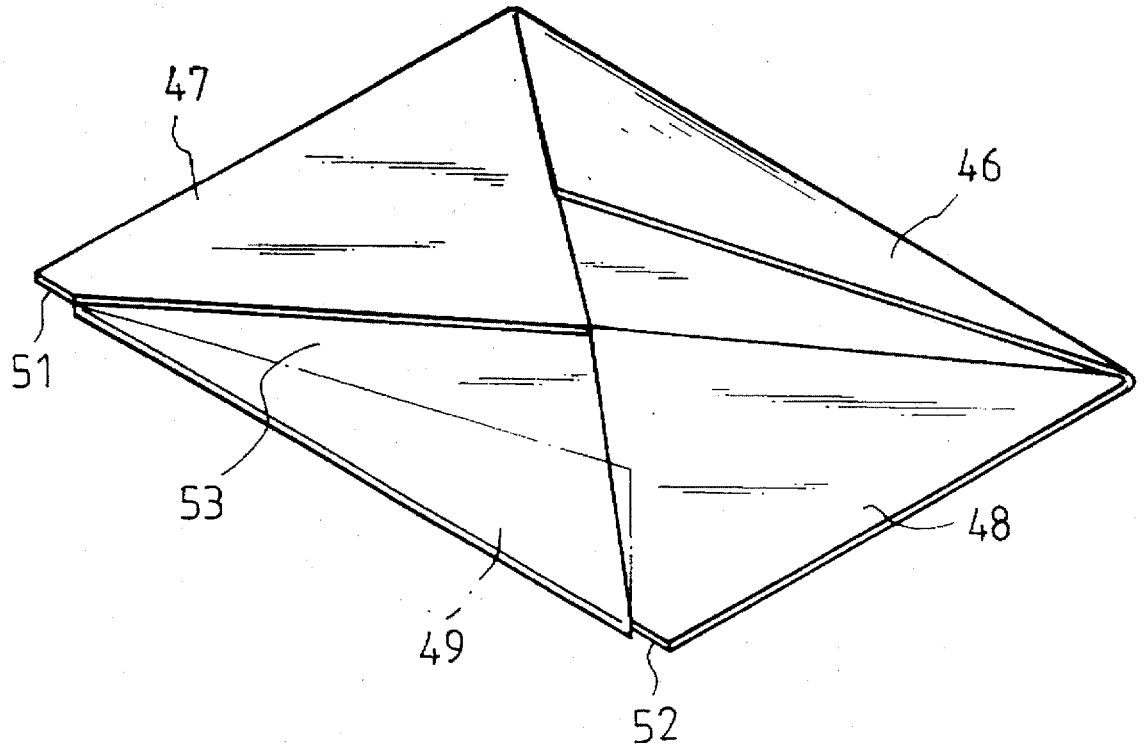
FIG. 6 is a perspective view to show a folded out book page of FIG. 5.

Referring to FIGS. 5 and 6, another altenative embodiment of a bouble-layer book page of the present invention is shown, which is made of a parallelogram paper or cardboard 40. Folding lines 41, 42 and 43 connect the centers of the four sides, where the folding line 44 parallel to folding line 41 is slightly inward so as to have a V shaped portion 45 cut out of the paper. The folding lines 41, 42, 43 and 44 define a rectangular portion 50 therein and four triangular flap members 46, 47, 48 and 49 abutting four sides of the rectangular portion 50. A pair of small sides 51 and 52 which are equally divided by the folding lines 42 and 43 respectively are provided for durable purpose. To accomplish a double-layer book page is to fold the triangular flap members 46, 47 and 48 upward along their respective folding lines 41, 42 and 43 and stuck on the upper surface of the rectangular portion 50. The triangular member 49 is folded downward long the folding line 44 and remained movable abutting the under side of the rectangular portion 50, therefore a triangular concave 53 is defined thereon corresponding to the triangular member 49 (as shown in FIG. 6). When binding, nest and stick up the triangular flap member 49 of each page into the triangular concave 53 of their adjacent lower pages and then bind with hard covers.

Figure 7:
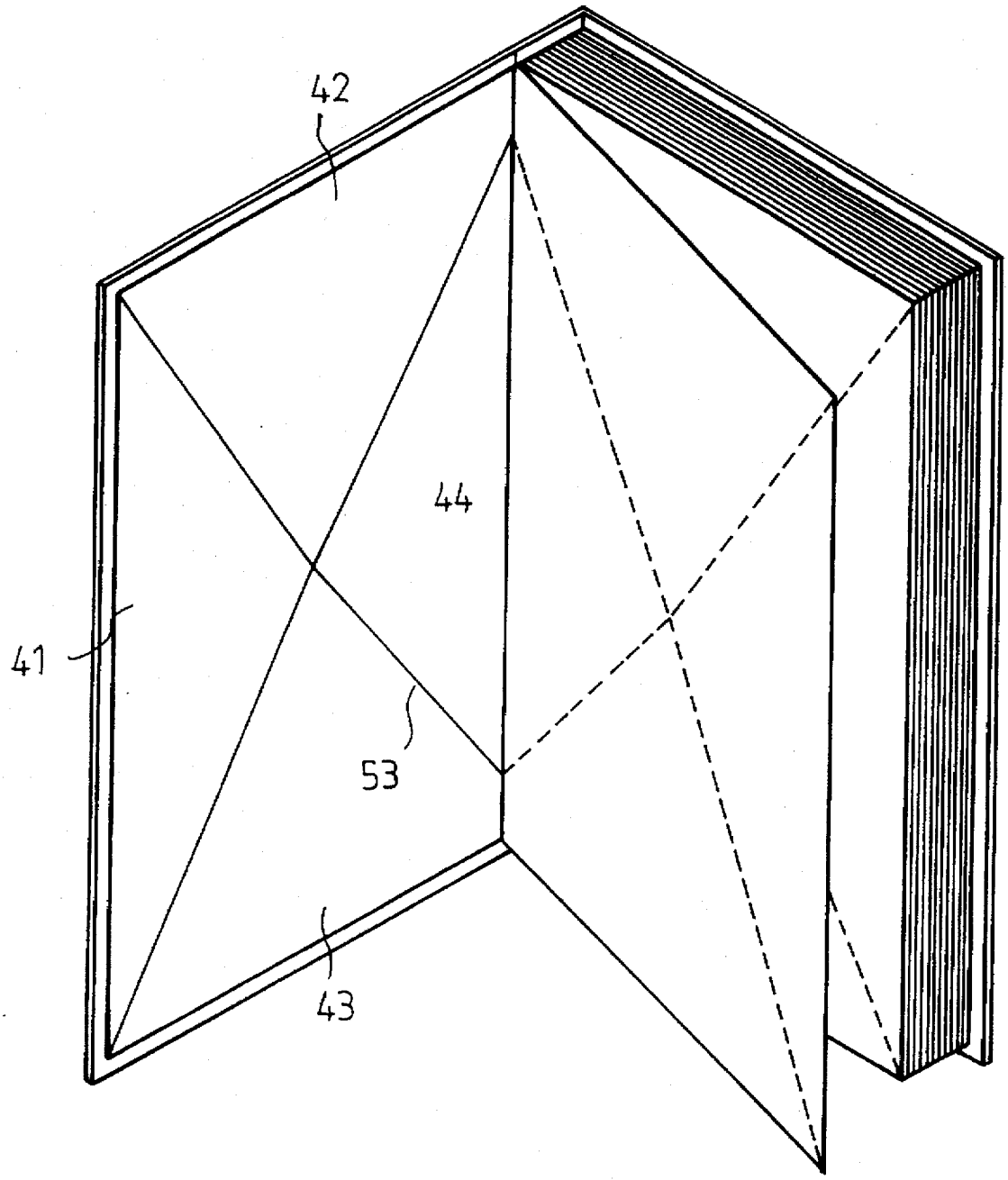
FIG. 7 is a perspective view to show a book or album according to the present invention.

Referring to FIG. 7, an opening book or album according to the third embodiment of the present invention is shown in which you will see that the triangular flap member 44 of an upper page nests and sticks up into the triangular concave 53 of an adjacent lower page. Substantially, every page including those in the above embodiments bind together in the same manner. Upon such arrangement, book pages will be more durable without hemming selvages and the book or album is ready to thumb through.

Note that the specification relating to the above embodiments should be construed as to exemplary rather than as limitative of the present invention, with many variations and modifications being readily attainable by a person of arerage skill in the art without departing from the spirit or scope appended claims and their legal thereof as defined by the equivalents.

I claim:

1. A structure of book page for binding a book or album comprising:

a wide rectangular portion, a narrow rectangular portion abutting one end of said wide rectangular portion, a pair of first flap members respectively abutting two lateral sides perpendicular to said one end and a second flap member abutting other end of said wide rectangular portion, said narrow rectangular portion and said pair of first flap members being folded upward along their predetermined folding lines and adhered on an upper surface of said wide rectangular portion for defining a concave strip along an inside margin of said book page, said second flap member being folded downward along another predetermined folding tine to define a convex strip movably matted with an under side of said concave strip;

whereby, said book pages are bound together by sequentially nesting said convex strip of said upper book pages into said concave strip of said adjacent lower book pages.

2. A book page as claimed in claim 1, wherein said book page is made from paper or cardboard.

3. A book page as claimed in claim 1, further has a hard cover to bind said book pages.

4. A book page as claimed in claim 1, wherein the each end of said second flap member is equally cut a small parallelogram portion.

5. A structure of book page for binding a book or album comprising:

a rectangular portion having a first triangular flap member abutting a lateral side, a pair of second triangular flap members abutting two ends respectively and a third triangular flap member abutting another lateral side thereof;

said first and second triangular flap members being folded upward along their predetermined folding lines and adhered to an upper surface of said rectangular portion for defining a triangular concave on a top of said rectangular portion, said third triangular flap member being folded downward along another predetermined folding line and movably matted with the under side of said triangular concave;

whereby, said book pages are bound together by sequentially nesting said third triangular flap member of said upper book pages into the triangular concave of said adjacent lower book pages.

6. A book page as claimed in claim 5 wherein said third triangular flap member is smaller than said first and second triangular flap members and has two base angles positioned slightly inward from the corners of said rectangular portion.

7. A book page as claimed in claim 5 wherein said second triangular flap members each has a base angle being incised to conforming with a cut off V-shaped portion outside said third triangular flap member.

* * * * *